US007192093B2

(12) United States Patent
Jackson et al.

(10) Patent No.: US 7,192,093 B2
(45) Date of Patent: Mar. 20, 2007

(54) EXCAVATION APPARATUS AND METHOD

(75) Inventors: Eric Jackson, New Westminster (CA); Jim Friant, Seattle, WA (US)

(73) Assignee: Placer Dome Technical Services Limited, Vancouver (CA)

( * ) Notice: Subject to any disclaimer, the term of this patent is extended or adjusted under 35 U.S.C. 154(b) by 0 days.

(21) Appl. No.: 11/112,754

(22) Filed: Apr. 22, 2005

(65) Prior Publication Data

US 2006/0000121 A1 Jan. 5, 2006

Related U.S. Application Data

(60) Provisional application No. 60/633,158, filed on Dec. 3, 2004, provisional application No. 60/565,250, filed on Apr. 23, 2004.

(51) Int. Cl.
*E21C 25/56* (2006.01)
*E21C 31/00* (2006.01)

(52) U.S. Cl. ..... 299/10; 299/18

(58) Field of Classification Search ..... 299/30, 299/31, 1.8, 1.05, 1.7, 10, 18
See application file for complete search history.

(56) References Cited

U.S. PATENT DOCUMENTS

| | | | | |
|---|---|---|---|---|
| 919,105 | A * | 4/1909 | Wischow | 299/71 |
| 919,905 | A | 4/1909 | Wischow | |
| 1,211,679 | A | 1/1917 | Constantinesco | |
| 1,365,748 | A | 1/1921 | Thorn | |
| 1,566,460 | A | 12/1925 | Wyman | |
| 3,309,145 | A | 3/1967 | Arentzen | |
| 3,341,254 | A | 9/1967 | Arndt | |
| 3,371,964 | A | 3/1968 | Weber | |
| 3,477,762 | A | 11/1969 | Frenyo et al. | |
| 3,544,075 | A | 12/1970 | Sugden | |
| 3,581,500 | A | 6/1971 | Sugden | |

(Continued)

FOREIGN PATENT DOCUMENTS

| | | |
|---|---|---|
| AU | B-56857/80 | 3/1980 |

(Continued)

OTHER PUBLICATIONS

Larson, David A., et al. "Large-Scale Testing of the Ripper Fragmentation System," (U.S. Government Printing Office 1987) (19 pages).

(Continued)

*Primary Examiner*—John Kreck
(74) *Attorney, Agent, or Firm*—Sheridan Ross P.C.

(57) ABSTRACT

In one embodiment, an excavation method is provided that includes the steps of:

(a) contacting a rotating powered cutting head 440 of an excavator 400 with an excavation face 452, wherein, at any one time, a first set of the cutting elements is in contact with the excavation face and a second set of the cutting elements is not in contact with the excavation face, the cutting head excavating the excavation face in at least a first direction; and (b) during the contacting step, using an elongated support member 404 extending from the excavator 400 to a powered device 118 to apply a force to the excavator 400 in at least the first direction to provide at least a portion of the cutting force. The powered device 118 is located at a distance from the excavator 400.

9 Claims, 14 Drawing Sheets

U.S. PATENT DOCUMENTS 3,584,918 A 6/1971 Gaglione et al.
3,596,724 A 8/1971 Becham
3,598,445 A 8/1971 Winberg
3,620,573 A 11/1971 Oxford
3,647,263 A 3/1972 Lauber et al.
3,663,054 A 5/1972 Dubois
3,695,717 A 10/1972 Birrer
3,776,592 A 12/1973 Ewing
3,784,257 A 1/1974 Lauber et al.
3,788,703 A 1/1974 Thorpe
3,840,270 A 10/1974 Allgood
3,847,584 A 11/1974 Houser et al.
3,860,292 A 1/1975 Becham
3,861,748 A 1/1975 Cass
3,907,366 A 9/1975 Pender
3,957,310 A 5/1976 Winberg et al.
3,963,080 A 6/1976 Walker
4,045,088 A 8/1977 Becham
4,123,109 A 10/1978 Hill
4,159,852 A 7/1979 Montgomery
4,189,186 A 2/1980 Snyder
4,213,653 A 7/1980 Grenia
4,232,905 A 11/1980 Dick
4,284,368 A 8/1981 Albright
4,293,077 A 10/1981 Makino
4,312,541 A 1/1982 Spurgeon
4,323,280 A 4/1982 Lansberry
4,330,155 A 5/1982 Richardson et al.
4,375,594 A 3/1983 Ewanizky, Jr.
4,391,469 A 7/1983 Arsuaga
4,523,651 A 6/1985 Coon et al.
4,527,837 A 7/1985 Snyder
4,541,848 A 9/1985 Masuda
4,568,127 A 2/1986 Traumumiller et al.
4,572,583 A 2/1986 Traumumiller et al.
4,578,627 A 3/1986 Droscher et al.
4,591,209 A 5/1986 Droscher et al.
4,603,910 A 8/1986 Laneus
4,637,657 A 1/1987 Snyder
4,641,889 A 2/1987 Brandl
4,643,567 A 2/1987 Droscher et al.
4,662,685 A 5/1987 Barnthaler et al.
4,664,449 A 5/1987 Barnthaler et al.
4,669,785 A 6/1987 Brandl
4,688,855 A 8/1987 Barnthaler et al.
4,696,518 A 9/1987 Zitz et al.
4,711,502 A 12/1987 Barnthaler et al.
4,729,445 A 3/1988 Kolleth
4,735,458 A 4/1988 Wrulich et al.
4,736,987 A 4/1988 Lenzen et al.
4,741,405 A 5/1988 Moeny et al.
4,744,431 A 5/1988 Stollinger
4,753,484 A 6/1988 Stolarczyk
4,758,049 A 7/1988 Wernigg et al.
4,770,469 A 9/1988 Schellenberg et al.
4,784,439 A 11/1988 Wrulich et al.
4,786,112 A 11/1988 Brandl
4,796,713 A 1/1989 Bechem et al.
4,805,963 A 2/1989 Kogler et al.
4,815,543 A 3/1989 Lenzen et al.
4,834,197 A 5/1989 Bauer et al.
4,875,738 A 10/1989 Zitz et al.
4,878,714 A 11/1989 Barnthaler et al.
4,884,847 A 12/1989 Bessinger et al.
4,921,307 A 5/1990 Braun et al.
4,921,309 A 5/1990 Harrison
4,957,606 A 9/1990 Juvan
4,958,696 A 9/1990 Lerchbaum
4,966,417 A * 10/1990 Zitz et al. ..... 299/33
5,007,683 A 4/1991 Granskog
5,050,934 A 9/1991 Brandl et al.
5,072,994 A 12/1991 Brandl et al.
5,098,166 A 3/1992 Ebner et al.
5,103,705 A 4/1992 Bechem
5,108,154 A 4/1992 Brandl et al.
5,121,971 A 6/1992 Stolarczyk
5,161,857 A 11/1992 Mayercheck
5,178,494 A 1/1993 Zitz et al.
5,181,934 A 1/1993 Stolarczyk
5,190,353 A 3/1993 Bechem
5,228,552 A 7/1993 Brandl et al.
5,234,257 A 8/1993 Sugden et al.
5,268,683 A 12/1993 Stolarczyk
5,310,249 A 5/1994 Sugden et al.
5,333,936 A 8/1994 Zitz
5,340,199 A 8/1994 Piefenbrink et al.
5,368,369 A 11/1994 Maity et al.
5,438,517 A 8/1995 Sennott et al.
5,439,274 A 8/1995 Krueckl
5,513,903 A 5/1996 Mraz
5,557,979 A 9/1996 Krassnitzer et al.
5,582,467 A 12/1996 Drolet et al.
5,662,387 A * 9/1997 Bartkowiak ..... 299/55
5,680,760 A 10/1997 Lunzman
5,685,615 A 11/1997 Becham et al.
5,752,572 A 5/1998 Baiden et al.
5,810,447 A 9/1998 Christopher et al.
5,896,938 A 4/1999 Moeny et al.
5,939,986 A 8/1999 Schiffbauer et al.
5,964,305 A 10/1999 Arzberger et al.
5,992,941 A 11/1999 Delli-Gatti, Jr.
5,999,865 A 12/1999 Bloomquist et al.
6,027,175 A 2/2000 Seear et al.
6,058,029 A 5/2000 Itow et al.
6,109,699 A 8/2000 Mrau
6,139,477 A 10/2000 Becham et al.
6,164,388 A 12/2000 Martunovich et al.
6,206,478 B1 3/2001 Uehara et al.
6,215,734 B1 4/2001 Moeny
6,224,164 B1 5/2001 Hall et al.
6,244,664 B1 6/2001 Ebner et al.
6,257,671 B1 7/2001 Siebenhofer et al.
6,304,973 B1 10/2001 Williams
6,308,787 B1 10/2001 Alft
6,315,062 B1 11/2001 Alft et al.
6,431,653 B1 8/2002 Kleuters
6,505,892 B1 1/2003 Walker et al.
6,547,336 B2 4/2003 Hoffmann
6,857,706 B2 * 2/2005 Hames et al. ..... 299/18
2001/0015573 A1 8/2001 Mraz
2002/0074849 A1 6/2002 Paschedag et al.
2002/0093239 A1 7/2002 Sugden
2002/0096934 A1 7/2002 Seear et al.

FOREIGN PATENT DOCUMENTS

AU B-56858/80 3/1980
AU B-71066/81 5/1981
AU B-66910/81 8/1981
AU B-17369/83 7/1983
AU B-36721/84 11/1984
AU B-37937/85 1/1985
AU B-45200/85 7/1985
AU B-45843/85 8/1985
AU A-55091/86 3/1986
AU A-62506/86 9/1986
AU B-12696/88 3/1988
AU B-74104/94 9/1994
CA 1 214 797 12/1986
CA 1 218 388 2/1987
CA 1 262 368 10/1989
CA 2109921 5/1992
CA 2121044 9/1992
CA 2291043 5/1998

| | | | |
|---|---|---|---|
| EP | 115 942 | A2 | 1/1984 |
| EP | 115 942 | B1 | 5/1990 |
| EP | 0 791 694 | A1 | 8/1997 |
| FR | 1370085 | | 7/1963 |
| GB | 735749 | | 8/1953 |
| GB | 2120579 | A | 12/1983 |
| JP | 59192195 | A2 | 10/1984 |
| JP | WO 02/0145 | A1 | 1/2002 |
| WO | WO 82/01749 | | 5/1982 |
| WO | WO 84/02951 | | 8/1984 |
| WO | WO 85/02653 | | 6/1995 |
| WO | WO 97/48883 | | 12/1997 |
| WO | WO 98/35133 | | 8/1998 |
| WO | PCT/AU00/00030 | | 7/2000 |
| WO | PCT/AU00/00066 | | 8/2000 |
| WO | PCT/US0239594 | | 10/2002 |
| ZA | 82/1297 | | 2/1982 |
| ZA | 83/3060 | | 4/1983 |
| ZA | 84/9431 | | 12/1984 |
| ZA | 92/3454 | | 5/1992 |
| ZA | 92/3455 | | 5/1992 |
| ZA | 94/4480 | | 6/1994 |
| ZA | 97/4804 | | 12/1997 |
| ZA | 98/8239 | | 9/1998 |
| ZA | 99/2714 | | 10/1999 |
| ZA | 2000/7587 | | 12/2000 |
| ZA | 99/7873 | | 3/2001 |
| ZA | 2002/6394 | | 8/2002 |

OTHER PUBLICATIONS

PCT International Preliminary Examination Report for International App. No. PCT/IB03/05356 dated Mar. 2, 2005.
PCT Written Opinion for International App. No. PCT/IBO3/05356 dated Dec. 21, 2004.
AGH Associates, "Reef Miner Projects," http://www.reefminer.com/, Sep. 24, 2001, 2 pages.
AGH Associates, "Reef Miner Questions," http://www.reefminer.com/page3.html, 2 pages.
AGH Associates, "Reef Miner Description," http://www.reefminer.com/page2.html,2 pages.
Brochure entitled "BAUER Trench Cutter Systems" 23 pages.
Application Notes, Hi-Vac, 12 pages, undated.
New-Vac Mining Brochure, 9 pages, undated.
Sixth International Symposium on Mine Mechanization and Automation, the South Africa Institute of Mining and Metallurgy, Johannesburg 2000, 284 pages.
"McArthur River Uranium" *Mining Magazine* (Oct. 1997) http://www.wma-minelife.com/uranium/mining/art138.htm 6 pages.
PCT International Search Report for International App. No. PCT/US05/13905 dated Apr. 22, 2005.
PCT Written Opinion for International App. No. PCT/US05/13905 dated Apr. 22, 2005.

* cited by examiner

EXCAVATION APPARATUS AND METHOD

CROSS REFERENCE TO RELATED APPLICATION

The present application claims the benefits, under 35 U.S.C. §119(e), of U.S. Provisional Application Ser. No. 60/565,250, filed Apr. 23, 2004, entitled "Mining Method and Apparatus," and Ser. No. 60/633,158, filed Dec. 3, 2004, entitled "Rock Cutting Method and Apparatus," each of which is incorporated herein by this reference.

Cross reference is made to U.S. patent application Ser. No. 10/688,216, filed Oct. 16, 2003, entitled "Automated Excavation Machine," and Ser. No. 10/309,237, filed Dec. 4, 2002, entitled "Mining Method for Steeply Dipping Ore Bodies" (now issued as U.S. Pat. No. 6,857,706), each of which is incorporated herein by this reference.

FIELD

The invention relates generally to mining valuable mineral and/or metal deposits and particularly to mining machines and methods for continuous or semi-continuous mining or such deposits.

BACKGROUND

Annually, underground mining of valuable materials is the cause of numerous injuries to and deaths of mine personnel. Governments worldwide have enacted restrictive and wide-ranging regulations to protect the safety of mine personnel. The resulting measures required to comply with the regulations have been a contributing cause of significant increases in underground mining costs. Further increases in mining costs are attributable to global increases in labor costs generally. Increases in mining costs have caused numerous low grade deposits to be uneconomic to mine and therefore caused high rates of inflation in consumer products.

To reduce mining costs and provide for increased personnel safety, a vast amount of research has been performed to develop a mining machine that can excavate materials continuously and remotely. Although success has been realized in developing machines to mine materials continuously in soft deposits, such as coal, soda ash, talc, and other sedimentary materials, there continue to be problems in developing a machine to mine materials continuously in hard deposits, such as igneous and metamorphic materials. As used herein, "soft rock" refers to in situ material having an unconfined compressive strength of no more than about 100 MPa (14,000 psi) and a tensile strength of no more than about 13.0 MPa (2,383 psi) while "hard rock" refers to in situ material having an unconfined compressive strength of at least about 150 MPa (21,750 psi) and a tensile strength of at least about 15 MPa (2,750 psi). Ongoing obstacles to developing a commercially acceptable continuous mining machine for hard materials include the difficulties of balancing machine weight, size, and power consumption against the need to impart sufficient force to the cutting device to cut rock effectively while substantially minimizing dilution, maintaining machine capital and operating costs at acceptable levels, and designing a machine having a high level of operator safety.

For example, a common excavator design for excavating hard rock is an articulated excavator having a rotating boom manipulated by thrust cylinders and an unpowered cutting head having passive cutting devices, such as a box-type cutter using discs or button cutters. Such excavators typically only impart 25% of the available power into actual cutting of the rock and can be highly inefficient. Unproductive parts of the cutting cycle are substantial. For example, repositioning of the excavator requires some actuators to be extended and others retracted until a desired position is reached at which point the extended actuators are retracted and the retracted actuators extended. During excavator repositioning, no excavation occurs.

SUMMARY

These and other needs are addressed by the various embodiments and configurations of the present invention. The present invention is generally directed to the use of a powered cutter head and/or elongated support member (such as a cable or wire rope) in the excavation of various materials, particularly hard materials.

In a first embodiment of the present invention, an excavation method is provided that includes the steps:

(a) contacting a cutting head with an excavation face; and (b) during the contacting step, using an elongated support member extending from the excavator to a powered device (e.g., a winch), located at a distance from the excavator, to apply a force to the excavator in a direction of excavation to provide at least a portion of the cutting force.

In a second embodiment, an excavation is provided that includes the steps:

(a) in a deposit of a material to be excavated, the deposit having a dip of at least about 35°, providing a number of intersecting excavations including first and second spaced part excavations extending in a direction of a strike of the deposit and a third excavation intersecting the first and second excavations and extending in a direction of the dip of the deposit, the first, second, and third excavations defining a block of the deposit;

(b) positioning the excavator in the third excavation;

(c) positioning a mobile deployment system in the first excavation, the support member extending from the mobile deployment system to the excavator; and (d) contacting the cutting head with the excavation face of the block such that, at any one time, a first set of the cutting elements is in contact with the excavation face and a second set of the cutting elements is not in contact with the excavation face.

The use of a powered, rotating cutting head, particularly one having a number of small discs, that cuts the advancing excavation face from the side of the cutting head can provide advantages relative to conventional excavators using box-type cutting heads. At any one time, only a portion of the discs are in contact with the rock and cutting; the remainder are out of contact with the rock and not cutting. The required cutting forces are typically drastically reduced compared to the box-type cutting head, in which all of the cutters are in continuous contact with the excavation face during cutting. Moreover, an excavator using a powered cutting head to cut rock on only one side of the cutting head generally has only to push hard in one direction. An excavator using a box-type cutting head, however, generally must push hard in two directions and must travel much farther than the power cutting head. Consequently, an excavator using a powered cutting head can be much smaller than an excavator using a box-type cutting head. By way of illustration, a typical box-type cutting head excavator must handle about 300,000 pounds of thrust so the bearings are quite large, thereby enlarging substantially the overall machine size. In comparison, an excavator having a powered cutting head need only handle small thrust loads so its bearings and the entire machine can be made much smaller. A powered cutting head commonly requires a cutting force of less than about 50,000 lbs and more typically ranging from about 30,000 to about 40,000 lbs.

In a third embodiment, a mobile deployment frame for an excavator is provided that includes:

(a) first and second arms disposed on either side of the frame;

(b) a central body member positioned between and connected to the first and second arms;

(c) a number of transportation members (e.g., wheels, tracks, rubber tires, etc.) operative to permit spatial displacement of the frame; and (d) a first winch to manipulate the excavator.

The deployment frame can not only perform excavator support during excavation-but also assist the excavator in self-collaring at the start of an excavation cycle. The area defined by the first and second arms and the central body member is large enough to receive the excavator.

In a fourth embodiment, an excavator is provided that includes:

(a) a body;

(b) actuators;

(c) transportation members attached to the actuators;

(d) a cutting head; and (e) a cutting head drive assembly.

The position of the cutting head relative to the body is fixed relative to a direction of travel of the excavator while excavating.

The excavator can move continuously throughout the cycle of excavating a side of the block, thereby obviating the need for repositioning the excavator at a number of discrete locations and locking the excavator into a stationary position before the excavation cycle can be commenced. Accordingly, unproductive parts of the cutting cycle are substantially minimized.

The various excavators discussed above are readily adaptable to remotely controlled operation to provide increased personnel safety.

These and other advantages will be apparent from the disclosure of the invention(s) contained herein.

The above-described embodiments and configurations are neither complete nor exhaustive. As will be appreciated, other embodiments of the invention are possible utilizing, alone or in combination, one or more of the features set forth above or described in detail below.

As used herein, "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" means A alone, B alone, C alone, A and B together, A and C together, B and C together, or A, B and C together.

DETAILED DESCRIPTION

The various excavators of the present invention are particularly suited for mining steeply dipping hard or high strength mineral deposits (having a dip of about 35° or more and more typically of about 45° or more) having thicknesses from several inches to several feet. Preferably, the excavations used are similar to those discussed in U.S. Pat. No. 6,857,706, in which the deposit is divided into a series of blocks. Each block is delineated using multiple excavations, such as tunnels, headings, drifts, inclines, declines, etc., positioned above and below each block of the deposit (and typically in the plane of (and generally parallel to the strike of) the deposit) and multiple excavations, such as shafts, stopes, winzes, etc., positioned on either side of the block. As used herein, the "strike" of a deposit is the bearing of a horizontal line on the surface of the deposit, and the "dip" is the direction and angle of a deposit's inclination, measured from a horizontal plane, perpendicular to the strike. Although the excavation method is described with specific reference to steeply dipping deposits, it is to be understood that the excavators described herein can be used for any mining method for excavating a deposit having any strike or dip, whether horizontally or vertically disposed, and being hard or soft rock.

Figure 2:
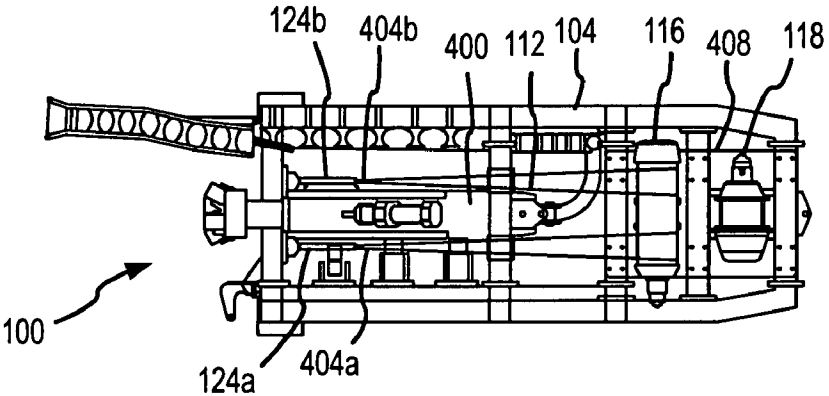
FIG. 2 is a top view of the mobile deployment frame of FIG. 1.
Figure 3:
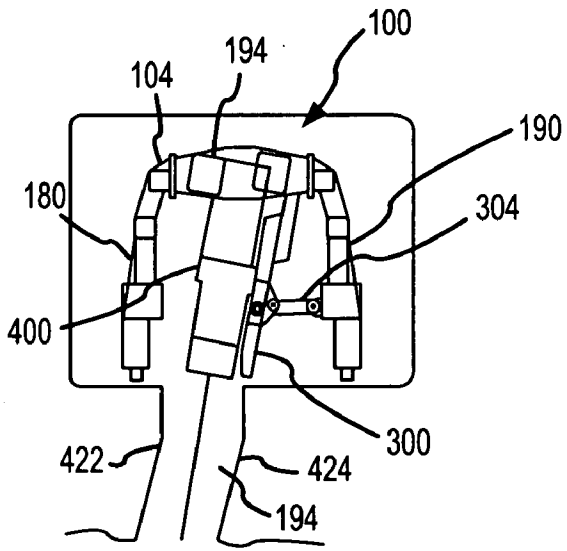
FIG. 3 is a front view of the mobile deployment frame of FIG. 1.
Figure 4:
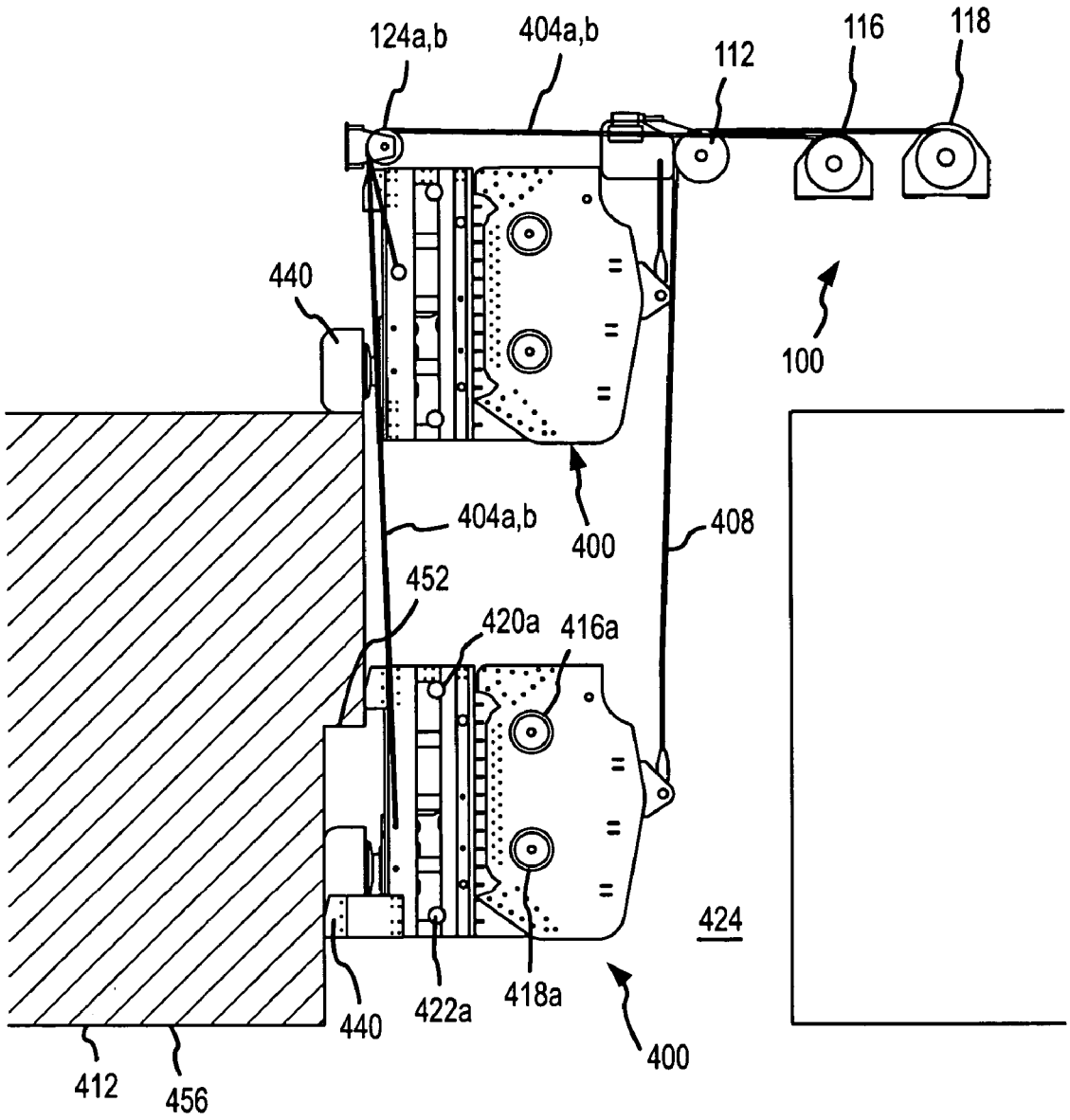
FIG. 4 is a side view of portions of the mobile deployment frame of FIG. 1 deploying an excavator according to a second embodiment of the present invention.
Figure 7:
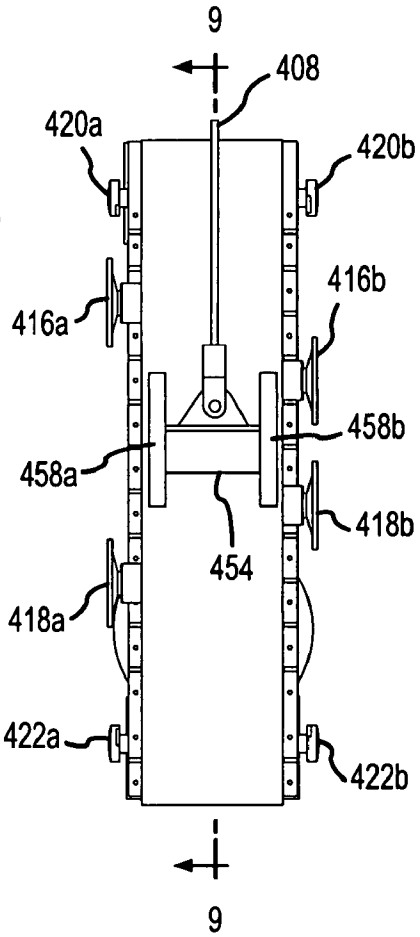
FIG. 7 is a rear view of the excavator of FIG. 5.
Figure 5:
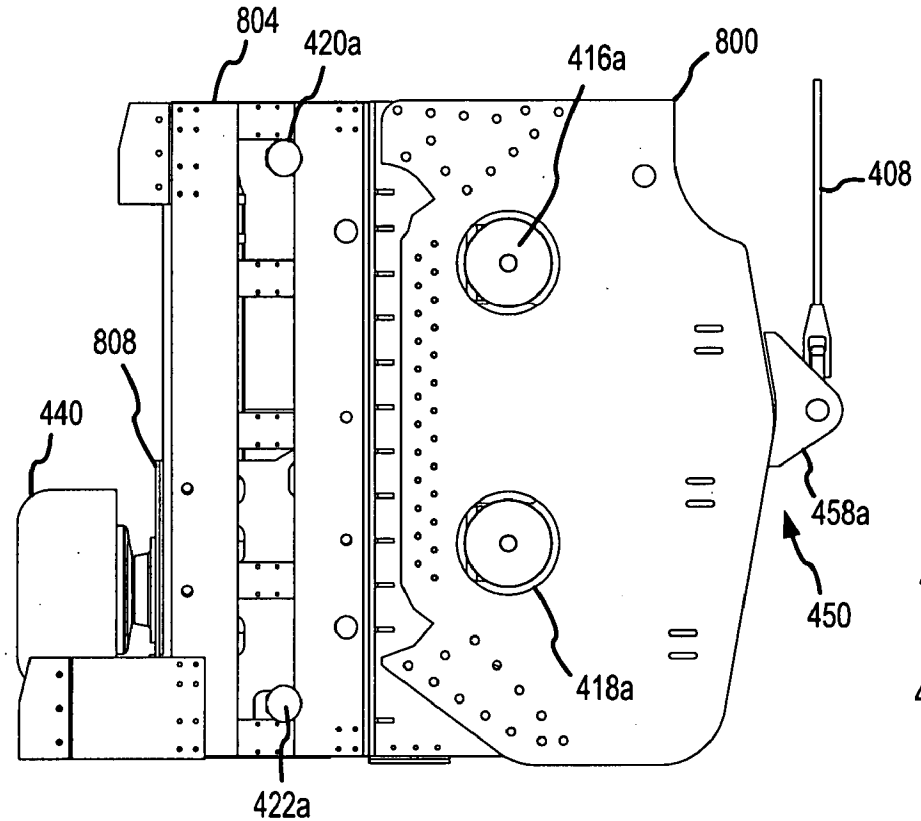
FIG. 5 is a plan view of the excavator of the second embodiment.
Figure 6:
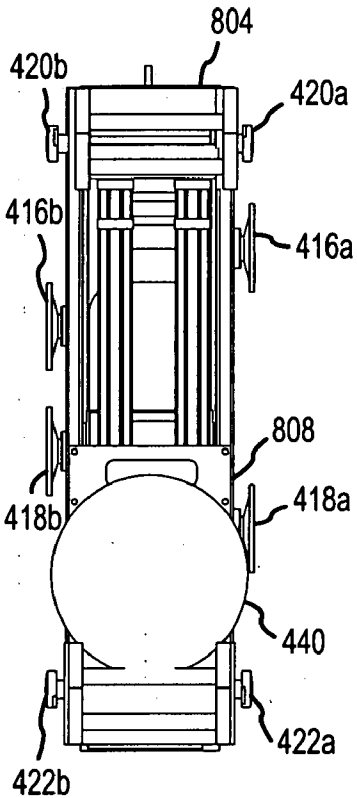
FIG. 6 is a front view of the excavator of FIG. 5.
Figure 8:
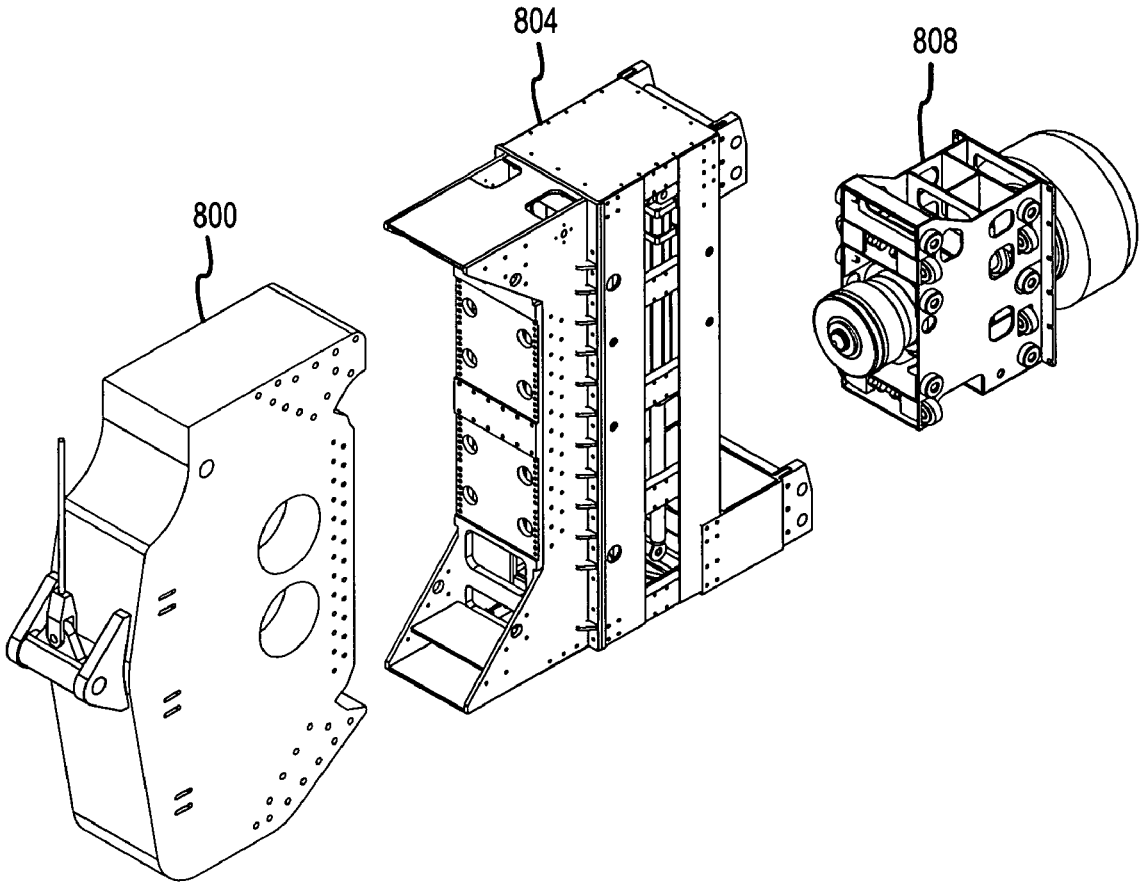
FIG. 8 is a disassembled view of the excavator of FIG. 5.
Figure 9:
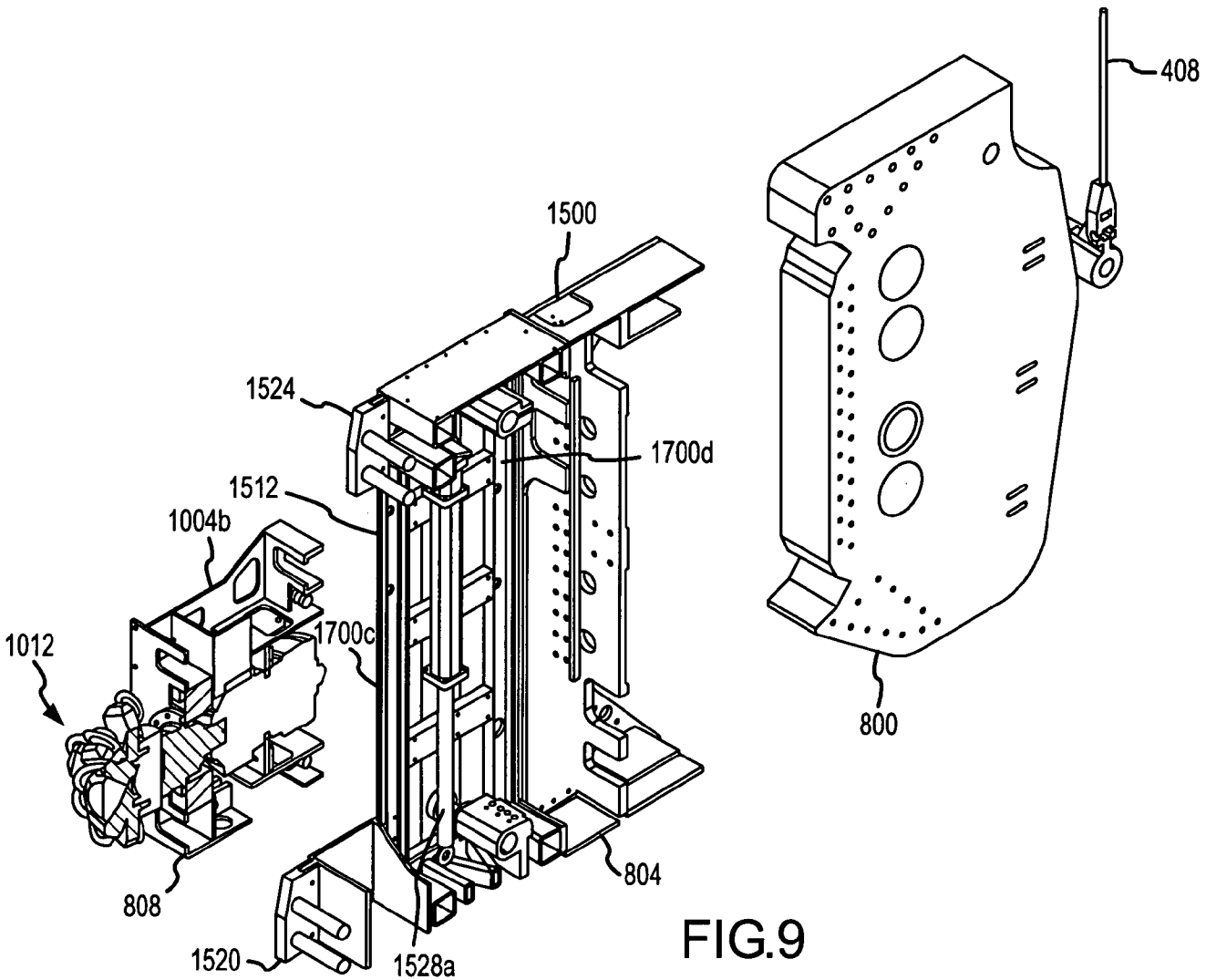
FIG. 9 is a cross-sectional view of the components of the excavator taken along line 9—9 of FIG. 5.
Figure 10:
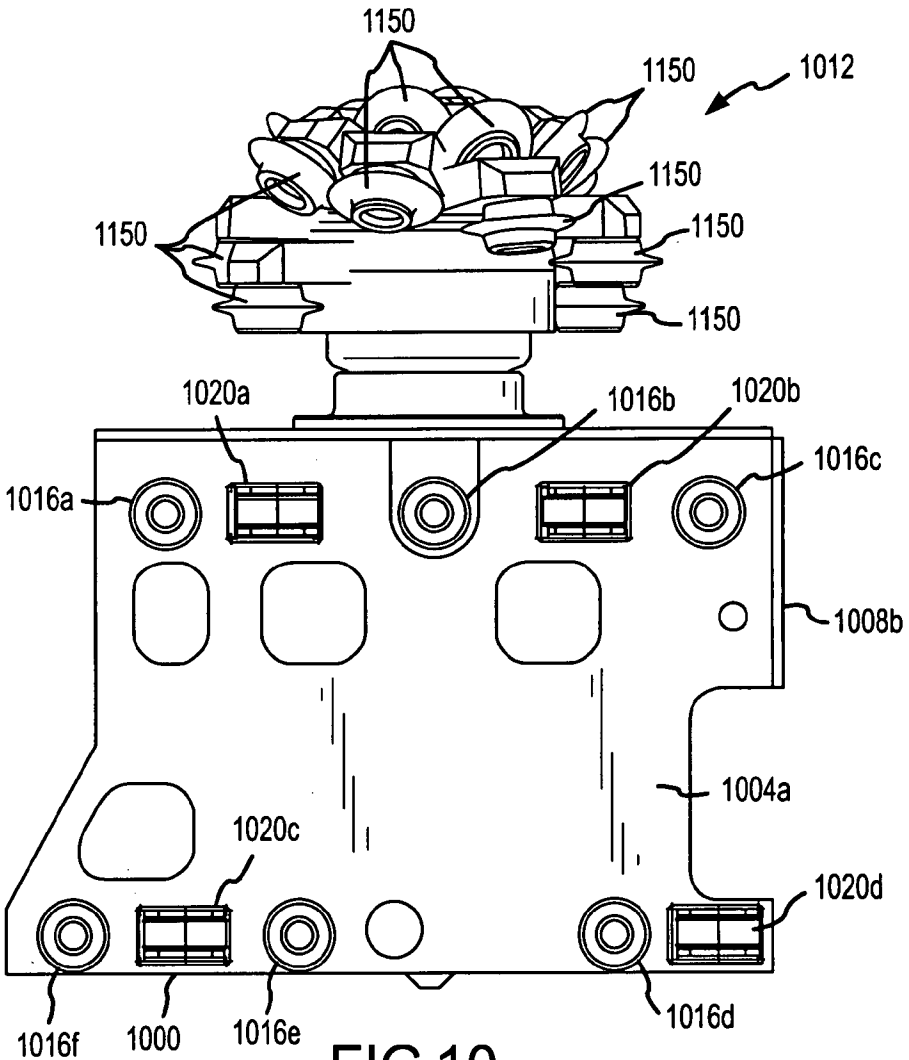
FIG. 10 is a side view of the cutter assembly of the excavator of FIG. 5.
Figure 11:
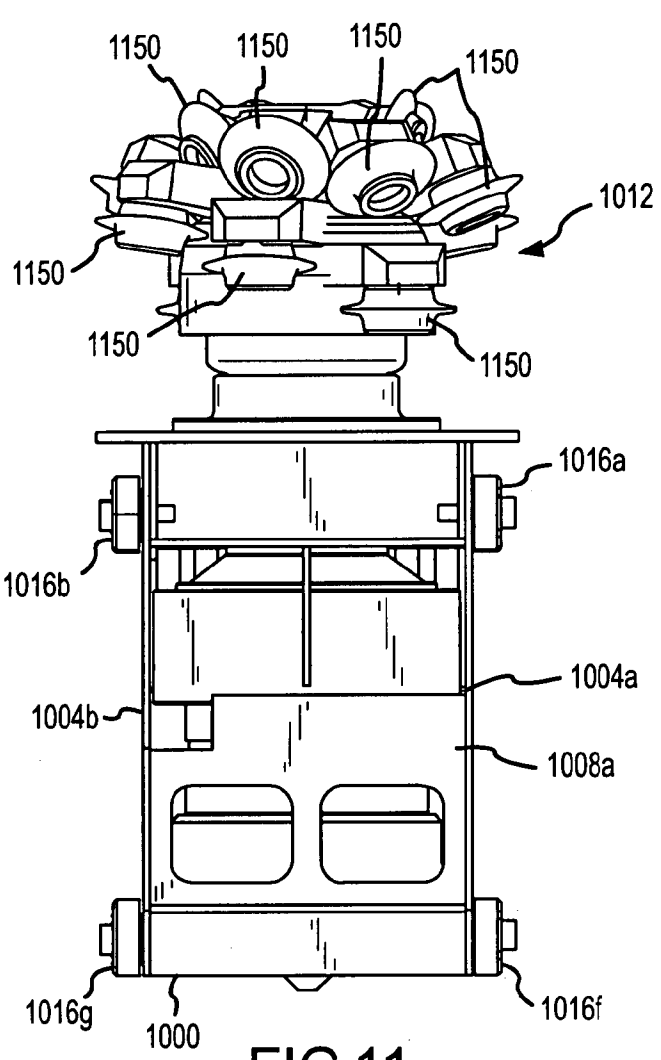
FIG. 11 is a bottom view of the cutter assembly of FIG. 10.
Figure 12:
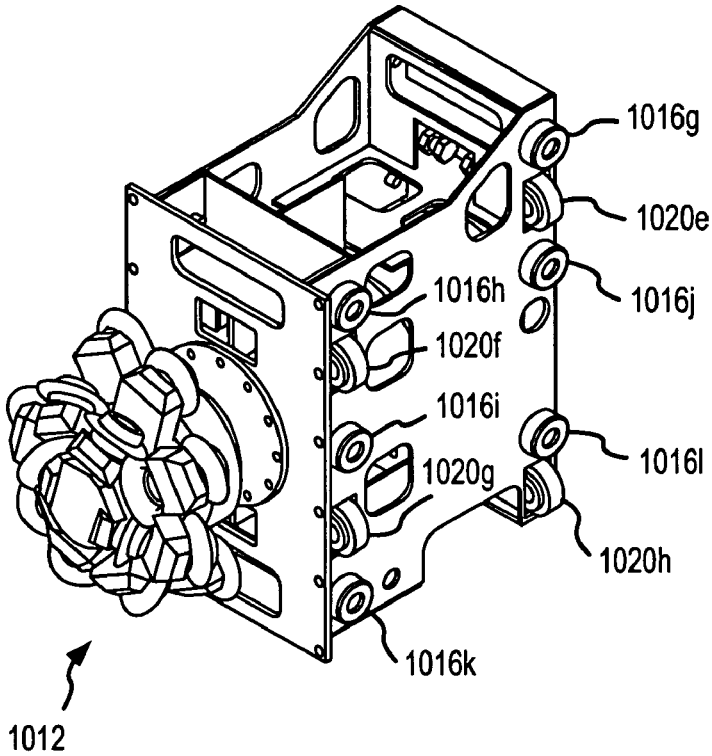
FIG. 12 is a front perspective view of the cutter assembly of FIG. 10.
Figure 13:
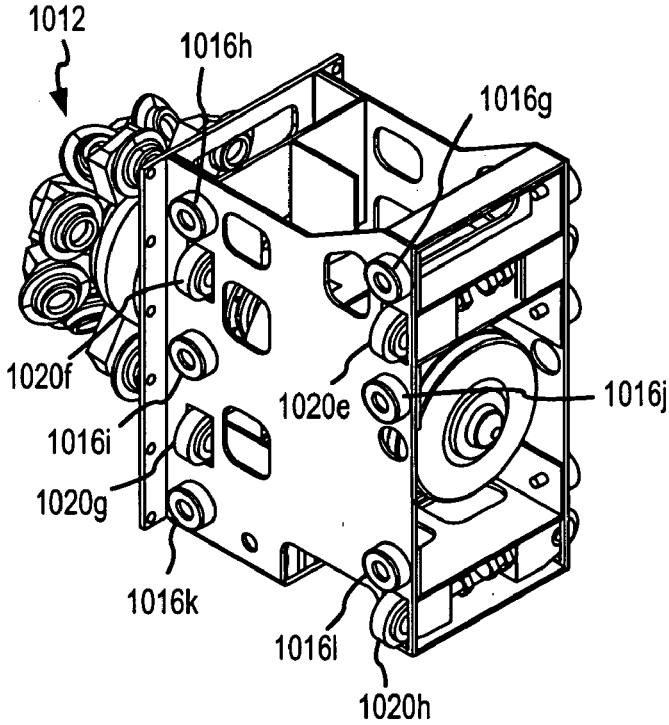
FIG. 13 is a rear perspective view of the cutter assembly of FIG. 10.

A first excavation system will now be discussed with reference to FIGS. 1–9. The system includes a mobile deployment system 100 for the excavator 400. As shown in FIG. 4 (which is a plan view in the plane of the deposit), the mobile deployment system 100 is positioned in the upper excavation and is operatively connected to the excavator 400 by means of a plurality of flexible supporting members 404 and 408 (such as cables or wire rope). The excavator 400 may be supported continuously or discontinuously by the members 404 and 408. For example, the excavator may be moved to various discrete positions along the face of the block 412. At each position the actuators 416*a,b*, 418*a,b*, 420*a,b*, and 422*a,b* are extended until the pad on the each of each actuator is in contact with the hanging wall 422 and footwall 424. When the cutting head 428 (which is shown in FIGS. 4–5, 8, 14A and 14B and 20 as being of a generic design) has been fully displaced laterally, the actuators 416*a,b*, 418*a,b*, 420*a,b*, and 422*a,b* are retracted and the excavator 400 moved by the support members 404 and 408 to a next position and the sequence repeated. When locked into position at each discrete position, such as the position shown in FIG. 4, the cutting head 440 is rotated (around an axis of rotation that is substantially perpendicular to the direction of advance) and the cutting head moved in the manner discussed below in the direction 444 (which is substantially parallel to the excavation face 448) to excavate a segment of the block 412 and advance the advancing excavation face 452 towards the upper end of the block 412. As will be appreciated, the cutting head 428 can be configured as a routing cutting head that not only cuts in the manner shown but also can plunge into the face 448 as part of excavation cycle to commence excavation of a next segment of the block 412.

The excavator 400 can self-collar to initiate excavation of a next segment. This capability is shown by FIGS. 1–4. The mobile deployment system 100 can lift the excavator cutting head 440 to a point about the block 412, move the excavator cutting head 440 to a point adjacent to the next advancing excavation face, and lower the rotating cutting head onto the block 412 to initiate a next pass. As can be seen in FIG. 3, the mobile deployment system 440 includes an excavator support member 300 rotatably mounted on the system 100 to hold an excavator (which is depicted as a conventional excavator described in copending U.S. patent application Ser. No. 10/688,216) in position while the next pass is initiated. Alternatively, the excavator 400 may, at the end of a pass, be lowered to the bottom face 456, moved to a starting position where the cutting head 440 is positioned adjacent to the new advancing excavation face, and the rotating cutting head 440 pushed (or pulled) into the face. In a steeply dipping ore body, the frame 100 will typically support a substantial amount of the weight of the excavator, more typically at least about 35% of the excavator weight, and even more typically at least about 50% of the excavator weight.

Figure 1:
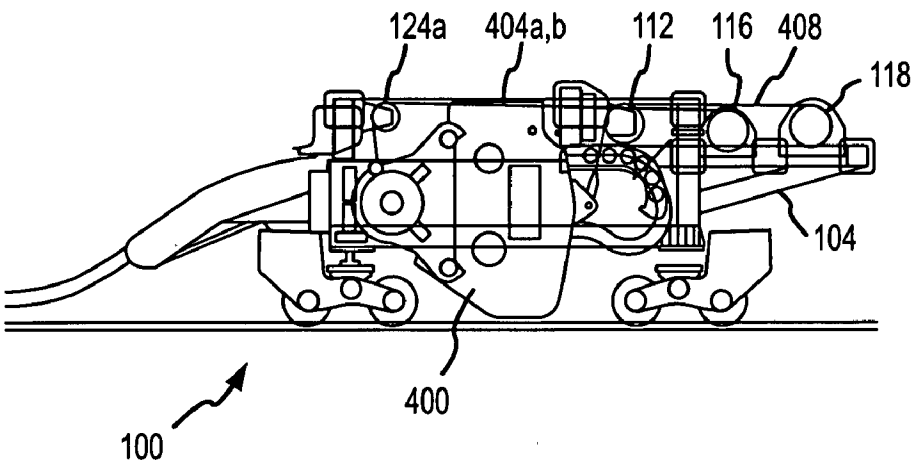
FIG. 1 is a side view of a mobile deployment frame according to a first embodiment of the present invention.

The mobile deployment system 100 will now be described in more detail with reference to FIGS. 1–3. The system 100 includes a support frame 104 comprised of a number of support members, the excavator support member 300 and hydraulic cylinder 304 for adjusting the orientation of the member 300, a number of wheels 108*a*–*h* (which may be rubber or inflated tires, rail mounted wheels (as shown), or caterpillar tracks) positioned on either side of the frame 104 to displace the system 100 forwards and backwards, first and second sets of sheaves 124*a,b* and 112, respectively, and first and second winches 116 and 118. The first winch 116 is in communication with the pair of first support members 404*a,b*, which respectively engage the first set of sheaves 124*a,b*, and are connected to the top and bottom of the front of the excavator 400. The second winch 118 is in communication with the second support member 408, which engages the second sheave 112 and is connected to the rear of the excavator 400. As can be seen from FIG. 3, the system 100 has two arms 180 and 190 straddling the slot 194 in which the excavator 400 is positioned. The arms are connected by a central body member 194.

Figure 27:
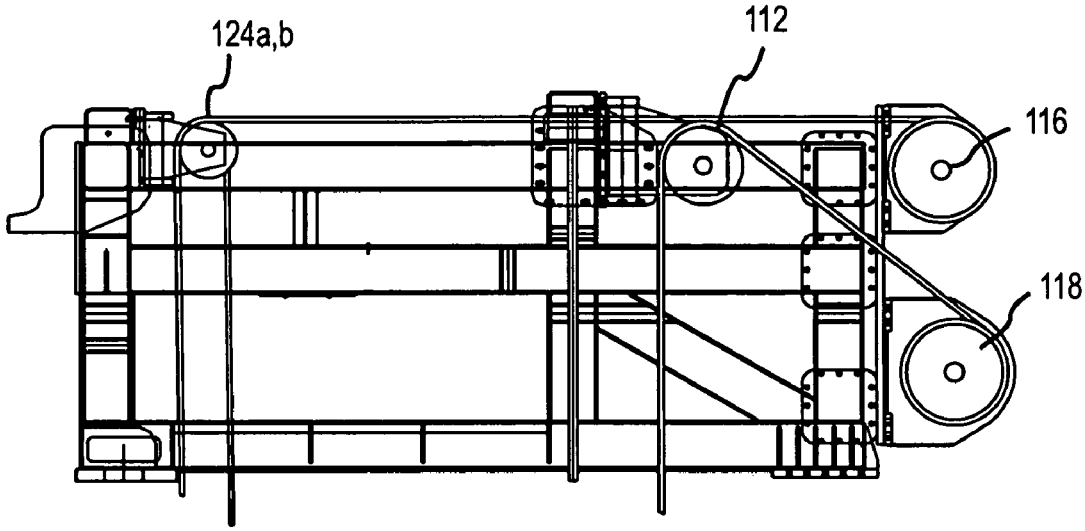
FIG. 27 is a side view of a portion of a mobile deployment frame according to a fifth embodiment of the present invention.

An alternative configuration of the system 100 is shown in FIG. 27. In this configuration, the second winch 118 is positioned below the first winch 116. Alternatively, the first winch 116 can be positioned below the second winch 118.

The excavator 400 will now be discussed with reference to FIGS. 6–9. The excavator 400 includes a hydraulic manifold 800, a stationary frame 804 rigidly mounted on the manifold 800, and a sliding cutter assembly 808 slidably mounted in the stationary frame 804 so that the assembly 808 may be moved laterally with respect to the stationary frame 804 in the manner shown by direction 444 in FIG. 4.

The manifold 800 contains the actuators 416, 418, 420, and 422, hydraulic components needed to support the actuators and thrust cylinders in the stationary frame (discussed below), excavator electronics, and control system for remotely controlled operation. Additionally, an umbilical (not shown) extending from the system 100 to the excavator 400 is typically connected to the manifold 800. The umbilical contains conduits for providing and returning pressurized hydraulic fluid and water and conductive members for providing electrical power and telemetry. The control system can be any suitable command and control logic such as that discussed in U.S. patent application Ser. No. 10/688,216, filed Oct. 16, 2003, entitled "Automated Excavation Machine." The support member 408 is attached to a rear attachment assembly 450 having an attachment member 454 rotatably engaging mounting members 458*a,b*.

The sliding cutter assembly 808 will be described with reference to FIGS. 9–13 and 14A,B. The sliding cutter assembly 808 includes a frame 1000 including side members 1004*a,b* and top and bottom members 1008*a,b*, a cutter drive assembly 1012, and a plurality of rollers 1016*a*–*l* and 1020*a*–*h* rotatably mounted on the frame 1000. The rollers 1016*a*–*l* and 1020*a*–*h* rotatably contact the stationary frame 804, thereby permitting the cutter assembly 808 to move laterally and linearly forwards and backwards relative to the frame 804.

Figure 14A:
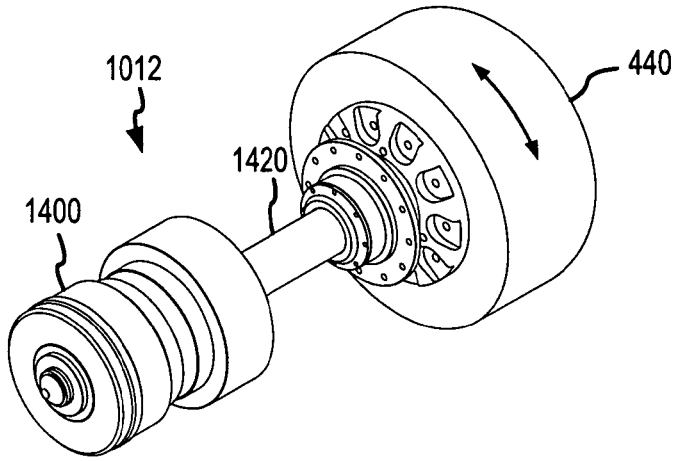
FIGS. 14A and B are, respectively, assembled and disassembled views of the cutter drive subassembly.
Figure 14B:
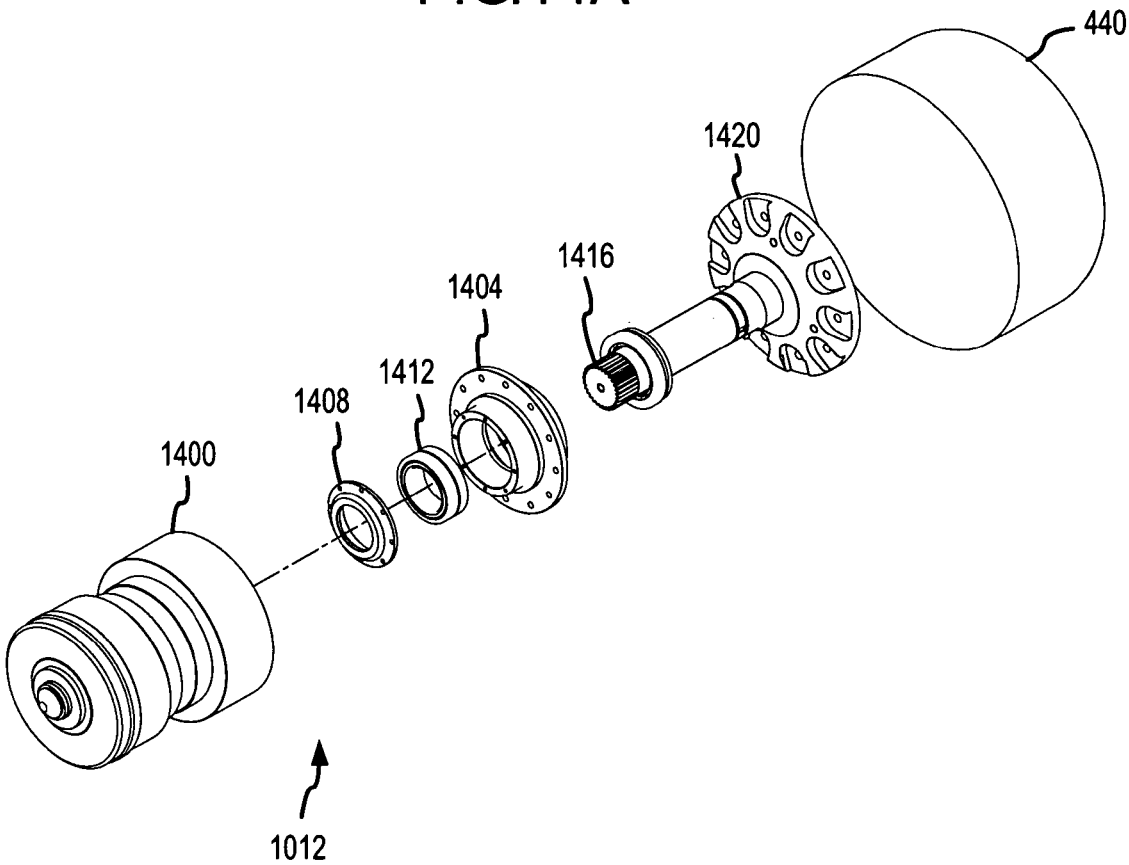
Figure 18:
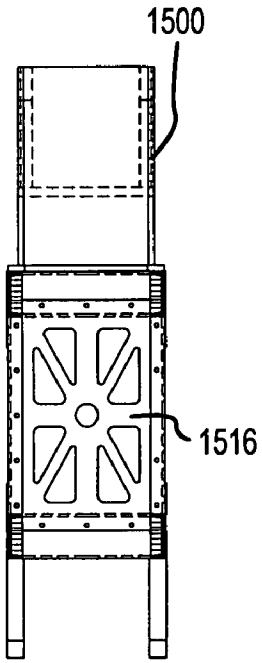
FIG. 18 is a bottom view of the stationary frame assembly of FIG. 8.
Figure 17:
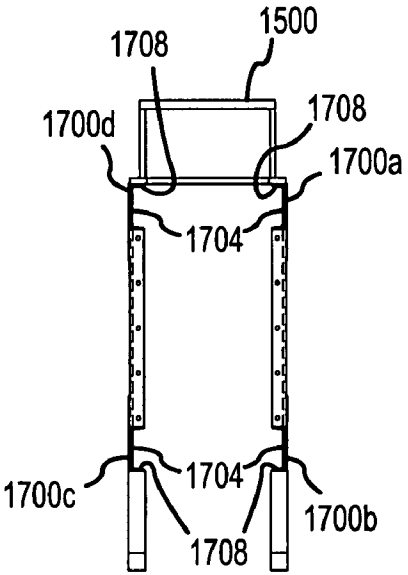
FIG. 17 is a cross sectional view of the stationary frame assembly taken along lines 17—17 of FIG. 15.
Figure 15:
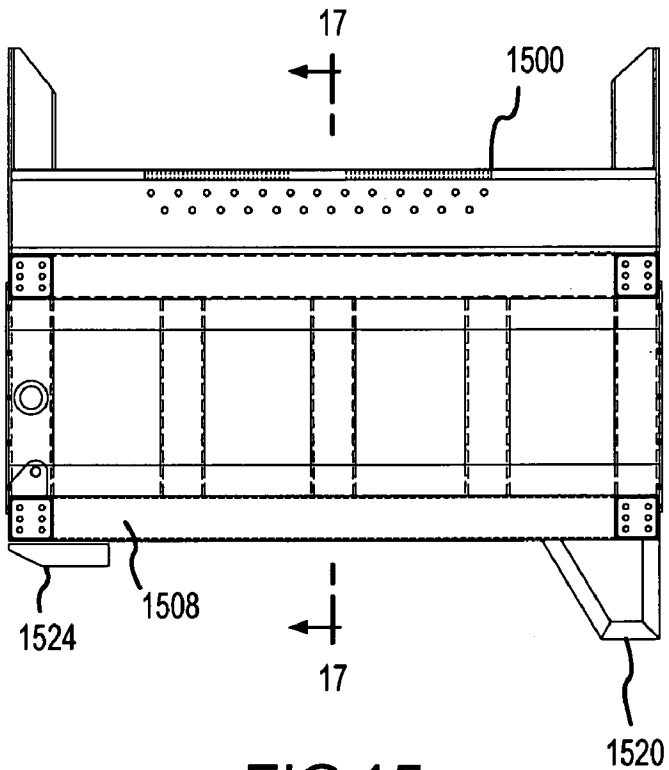
FIG. 15 is a side view of the stationary frame assembly of FIG. 8.
Figure 16:
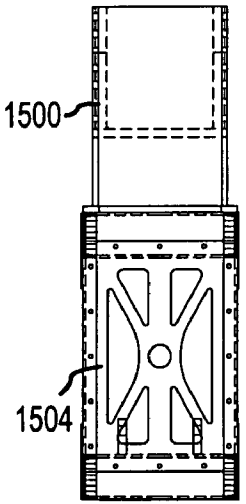
FIG. 16 is a top view of the stationary frame assembly of FIG. 8.
Figure 19:
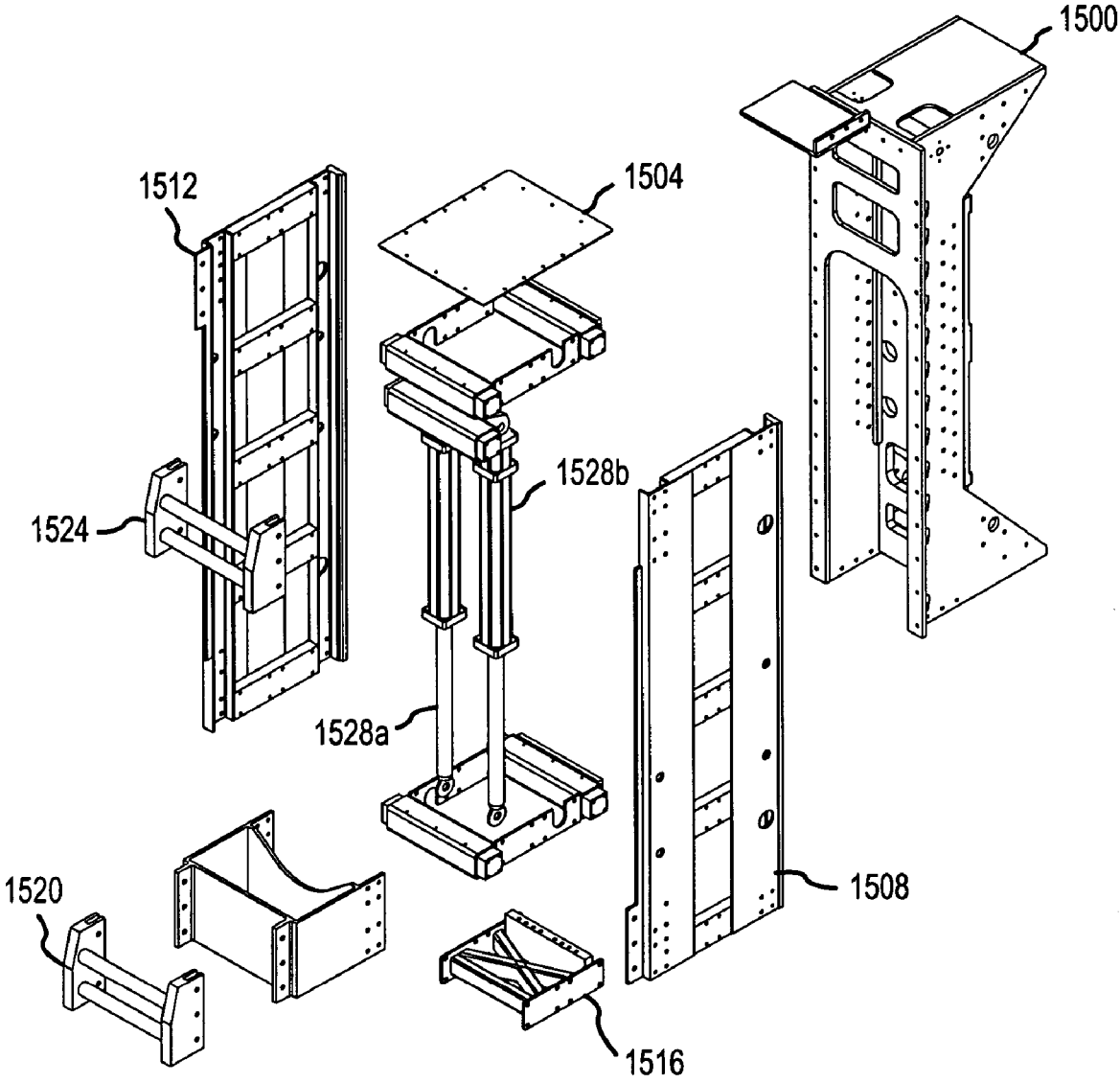
FIG. 19 is a disassembled view of the stationary frame assembly of FIG. 19.

The cutter drive assembly 1012 will be discussed with reference to FIGS. 14A and 14B. The cutter drive assembly 1012 includes a motor 1400, gearbox (not shown) (which is preferably attached to the motor through an internal spline coupling), bearings housing 1404 and bearing housing end-cap 1408, radial roller bearing 1412, thrust ball bearing 1416, and drive shaft 1420. The drive shaft 1420 rigidly engages the cutting head 440 (which has a number of discrete cutting elements 1150). As shown in FIGS. 14A and 14B, the drive shaft 1420 rotates the cutter head in the direction shown. Although the cutter drive assembly 1012 is depicted with a rotating cutting head, it is to be understood that a number of cutting head designs may be used, such as button cutters, disc cutters, minidisc cutters, vibrating disc cutters, undercutting disc cutters, and diamond picks, whether powered or unpowered. A powered rotating cutting head is preferred due to the lower cutting forces generally required to cut rock effectively compared to other cutter designs.

Finally, the stationary frame 804 is discussed with reference to FIGS. 15–19. The frame 804 accommodates not only the thrust cylinders for the cutting process but also the cameras, lights, water and air hoses. The frame 804 includes a rear frame 1500, a top frame 1504, side frames 1508 and 1512, a bottom frame 1516, a rear skid 1520, a front skid 1524 and thrust cylinders 1528*a,b*. The front and rear skids contact the excavation face during excavator (re)deployment. The structural members on each of the side frames 1508 and 1512 include channels 1700 for operatively contacting and guiding the rollers 1020*a–h* on channel surface 1704 and rollers 1016*a–l* on channel surface 1708. As will be appreciated, the rollers 1016*a–l* and 1020*a–h* preload the stationary frame, eliminate play between the sliding cutter assembly and stationary frame in the axial (rotational) direction of the cutter head (the radial play between the assembly 808 and frame 804 and cutting load are substantially borne by the four rollers 1020*a–h*), and maintain the sliding cutter assembly 808 in a substantially constant orientation relative to the stationary frame (or providing only one degree of freedom in the plane of the page of FIG. 4 and not in a plane normal to the plane of the page or in a direction transverse to the direction 444). The frame 804 further provides the attachment points for the support members 404*a,b* and accommodates the thrust cylinders, which displace the cutter assembly 808 up and down in the channels in direction 444. As will be appreciated, the thrust cylinders may be positioned between the sliding cutter assembly and the bottom frame 1516 as shown or between the top frame 1504 and sliding cutter assembly. In the former case, the thrust cylinders push the cutter assembly 808 into the advancing face 452 and, in the latter case, the thrust cylinders pull the cutter assembly 808 into the advancing face 452. Alternatively, the first winch 116 and/or a further winch and support member(s) (not shown) could be attached to the sliding cutter assembly 808 to displace the assembly 808 in the direction shown and to the desired position and provide the cutting thrust force for the cutting head 440.

The deployment frame 100 may be powered so as to be able to move in the excavation in which it is positioned and thereby move the excavator. Alternatively, the deployment frame 100 may be unpowered and towed by a powered vehicle or winch and cable assembly to effect movement of the excavator.

The operation of the excavator 400 will now be described with reference to FIGS. 1–7, 9–13, and 15–19. The excavator is moved, by manipulation of the support members 404*a,b* and 408 and movement of the deployment system 100, to a desired position, along the face of the block 412, from which to initiate a next cutting sequence. During movement, the cutter drive assembly is moved to a position adjacent to the rear skid 1520. The actuators 416*a,b*, 418*a,b*, 420*a,b*, and 422*a,b* are extended until the pad on each actuator is in contact with the hanging wall 422 and footwall 424. When locked into position at each discrete position, such as the position shown in FIG. 4, the cutting head 440 is rotated around an axis of rotation that is substantially perpendicular to the direction of advance and the cutting head moved in the direction 444 (which is substantially parallel to the excavation face 448) by extension of the thrust cylinders to excavate a segment of the block 412 and advance the advancing excavation face 452 towards the upper end of the block 412.

When the cutting head 428 has been fully displaced laterally, the actuators 416*a,b*, 418*a,b*, 420*a,b*, and 422*a,b* are retracted and the excavator 400 moved by the support members 404 and 408 to a next position and the sequence repeated. As can be seen from this description, the mobile deployment system 100 can provide both vertical thrust and position control.

Figure 20:
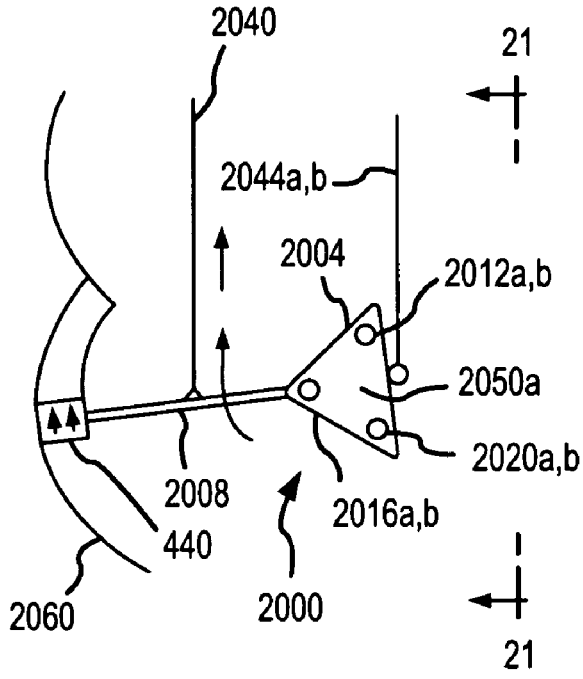
FIG. 20 is a plan view of an excavator according to a third embodiment of the present invention.
Figure 21:
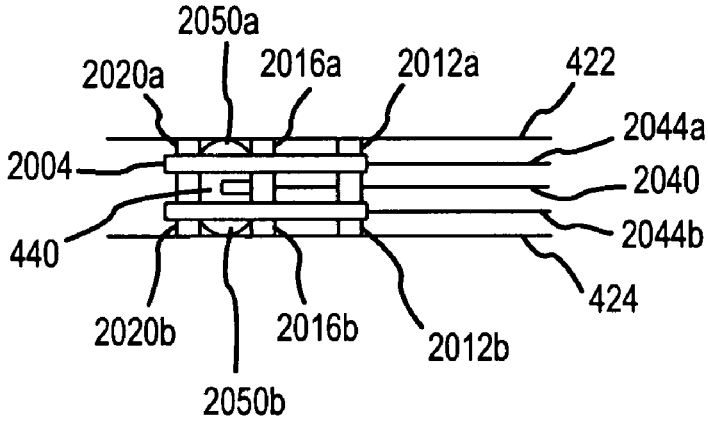
FIG. 21 is a view of the excavator of FIG. 20 taken along line 21—21 of FIG. 20.
Figure 23:
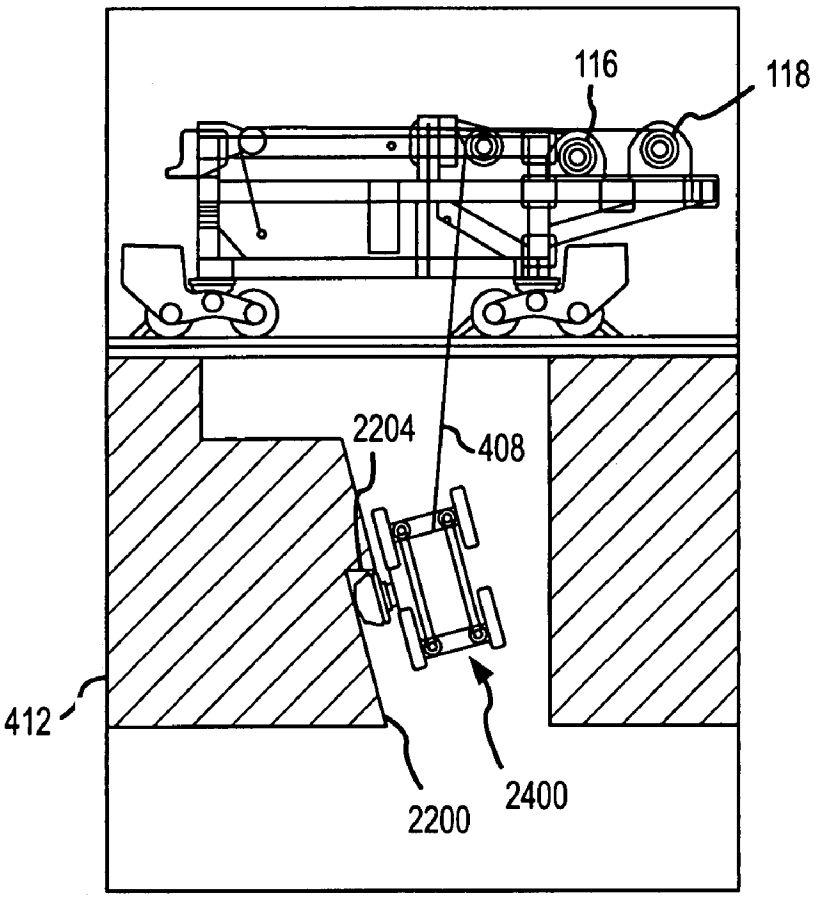
FIG. 23 is a further view of the excavator of FIG. 22 deployed in a slot.
Figure 22:
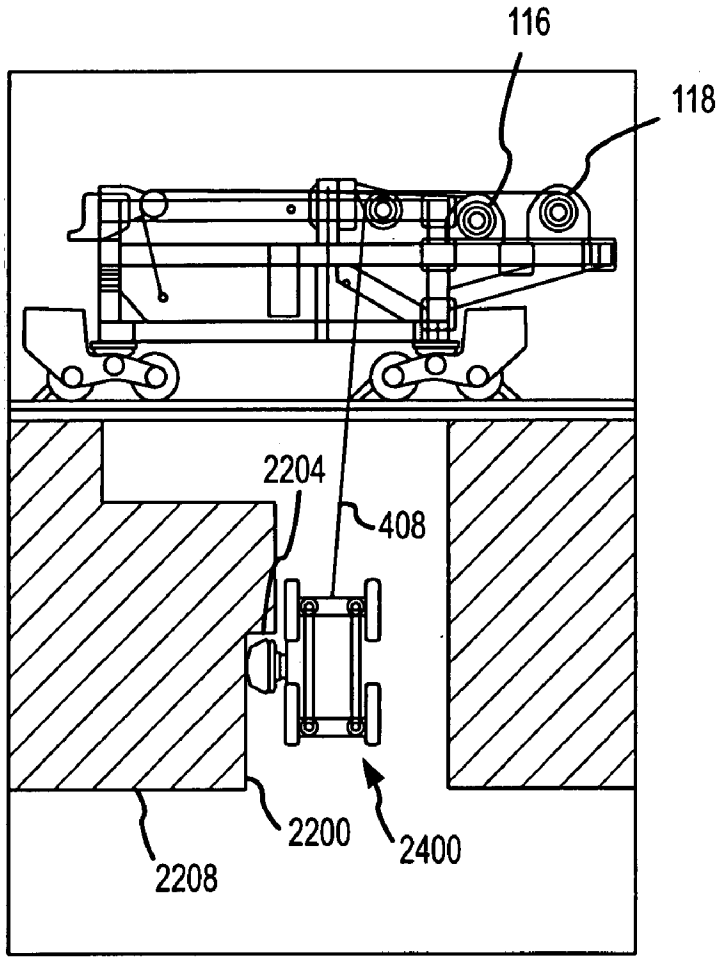
FIG. 22 is a plan view of an excavator according to a fourth embodiment of the present invention deployed in a slot.

FIGS. 20–21 depict a further embodiment of an excavator. The excavator 2000 includes a body 2004, a boom 2008 rotatably mounted on the body 2004, and a cutting head 440 rotatably mounted on the boom 2008. To rotate the cutting head 440, a motor may be included in the cutting head (with the boom not rotating with the cutting head) or a motor may be located in the body 2004 with the boom and cutting head rotating together. The body 2004 includes actuators 2012*a,b*, 2016*a,b*, and 2020*a,b* for engaging the hanging wall 422 and footwall 424. A support member 2020 is attached to the boom 2008. The boom pivots about an axis of rotation coincident with (and parallel to the longitudinal axis of) the actuators 2016*a,b*. Front and rear support members 2040 and 2044*a,b* are provided for positioning the excavator 2000. As will be appreciated, most of the cutting force required for effective excavation is provided by the cutting head motor.

Unlike the excavator of the prior embodiment which relies on hydraulic cylinders to provide a substantial portion of the required additional cutting forces to the cutting head 440, the excavator of this embodiment relies on the front support member 2040 to provide a substantial part of the required additional cutting forces. The use of hydraulic cylinders to provide a substantial part of the required additional cutting forces can require larger excavator sizes and weights to counteract the forces imparted by the cylinders. Using one or more winches and flexible, high strength support members, in contrast, coupled with a motorized, rotating cutting head can provide substantial reductions in the excavator size and weight required for acceptable excavation rates.

In operation, the excavator 2000 is positioned in a desired position by manipulation of the mobile deployment system 100 and the first and second winches. To accommodate the unique design of the excavator 2000, the positions of the support members are reversed relative to the positions shown in FIGS. 1–4. In other words, the dual support members are connected to the rear of the body while the single support member is attached to the front boom 2008. When in the desired position, the actuators 2012*a,b*, 2016*a,b*, and 2020*a,b* are extended and the pads locked in position on the hanging wall and footwall.

When in the desired position, the cutting head is rotated and upward force is applied to the boom by the support member 2044. The boom rotates about the forward actuators 2016*a,b* to form an arcuate cut 2060. The radius of the cut 2060 is, of course, the length of the boom and cutting head 440 measured from the axis of rotation of the boom. When the cutting head is passed through the excavation face as shown by the dotted lines, the actuators of the excavator are retracted and disengaged from the hanging wall and footwall and the excavator moved using the rear support members 2044*a,b*, to a next desired position to initiate a next cutting sequence.

As will be appreciated, the orientation of the "cut" or excavation pass by the cutting head can be controlled or "steered" by differentially extending the various actuators in the body. The plane of the excavation pass is generally parallel to the plane of the upper and lower plates 2050*a,b* of the body 2004 because the boom 2008 has freedom of movement only in the plane of the page of FIG. 20 and not in a plane perpendicular to the plane of the page. By properly extending the actuators to manipulate the plates to a desired three-dimensional orientation, the orientation of the cut can be manipulated at the same time.

A further embodiment of an excavator is shown in FIGS. 22–26.

Figure 24:
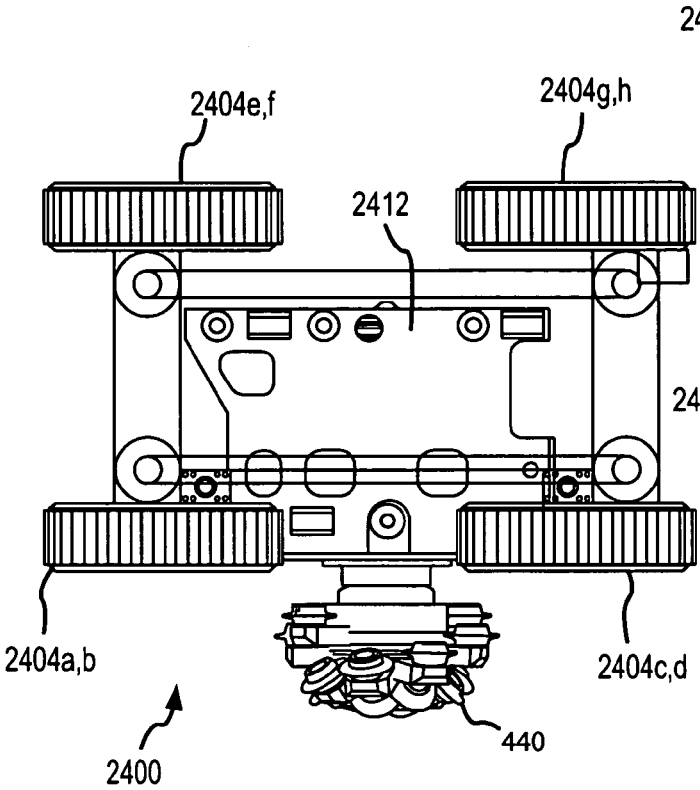
FIG. 24 is a plan view of the excavator of FIG. 22.
Figure 26:
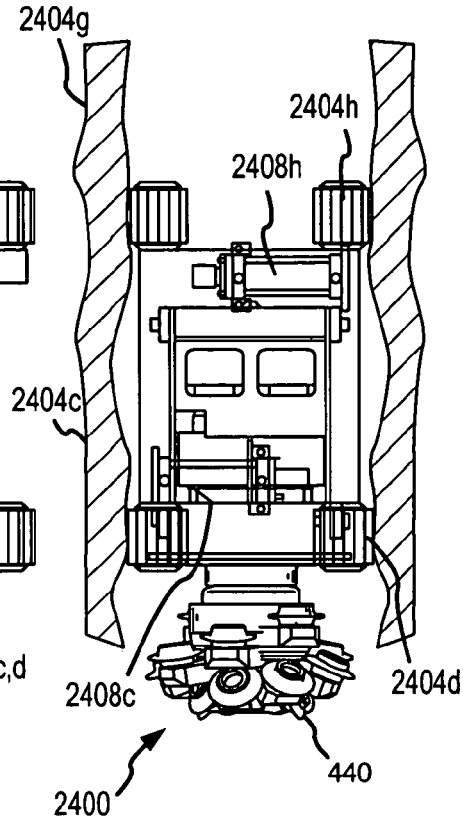
FIG. 26 is a side view of the excavator of FIG. 22 positioned in the slot.
Figure 25:
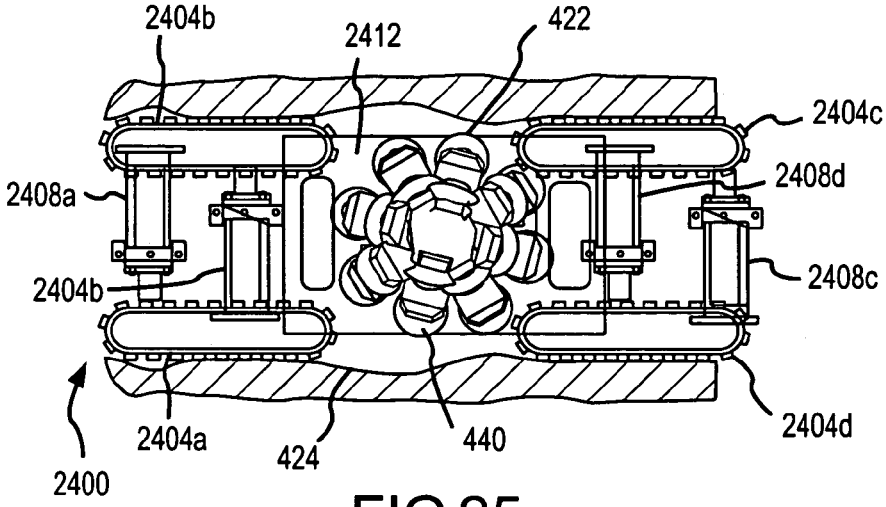
FIG. 25 is a front view of the excavator of FIG. 22 positioned in the slot.

Referring to FIGS. 24–26, the excavator 2400 includes a cutting head 440, a number of tracks 2404*a*–*h*, actuators 2408*a*–*h*, and a body member 2412 housing the cutter drive assembly 1012. The actuators 2408*a*–*h* extend a corresponding track 2402*a*–*h* to contact the hanging wall 422 or footwall 424 to movably maintain a desired position and orientation of the excavator 2400 relative to the excavation face 2200. The cutter drive assembly 1012 is rigidly mounted on the body member 2412 so that the assembly 1012 does not move laterally with respect to the body member. The cutting thrust force is provided by the support member 408 which is slowly retracted by winch 118 as the excavator 2400 progressively excavates and advances the advanced excavation face 2204. Even though the actuators are extended to cause contact of the tracks with the excavation walls, the tracks permit the excavator 2400 to move forward towards the mobile deployment system 100 as the support member 408 is spooled onto the winch 118. The advantage of this excavator over the excavators described above is that the excavator can move continuously throughout the cycle of excavating a pass of the block 412 while the excavators above must be repositioned discontinuously at a number of discrete locations along the excavation face and locked into a stationary position before the excavation cycle can be commenced. At the conclusion of a complete excavation pass of the face 220, the cutting head 440 of the excavator 2400 is lowered to a position below the lower block surface 2208 prior to the initiation of a next excavation pass.

A number of variations and modifications of the invention can be used. It would be possible to provide for some features of the invention without providing others.

For example in one alternative embodiment, the tracks 2404*a*–*h* are steerable (or rotatable in the plane of the page of FIG. 24) relative to the body member. This permits the excavator to be steered as it is being pulled. Typically, a linkage connects to opposing pairs of tracks, such as between tracks 2404*a,e*, 2404*b,f*, 2404*c,g*, and 2404*d,h* so that the pairs of tracks rotate in unison (or simultaneously to the same degree). Motors and/or hydraulic cylinders can be used to provide the motive force to steer the tracks.

In another embodiment, the powered winch is replaced by a powered vehicle that tows the excavator during excavation. This embodiment is particularly attractive for horizontal or relatively flat-lying deposits.

In another embodiment, the thrust force is provided collectively both internally, such as by one or more thrust cylinders, and externally, such as by a support member and winch.

The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g., for improving performance, achieving ease and\or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover, though the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. An excavation method, comprising: providing an excavator, the excavator having a powered, rotating cutting head, the cutting head having at least a plurality of cutting elements located on a side of the cutting head;

contacting the cutting head with a hard rock excavation face, wherein, at any one time, a first set of the cutting elements is in contact with the excavation face and a second set of the cutting elements is not in contact with the excavation face and wherein, in the contacting step, the cutting head excavates the excavation face in at least a first direction; and during the contacting step, using an elongated support member extending from the excavator to a powered device to apply a force to the excavator in at least the first direction to provide at least a portion of the cutting force, wherein the powered device is located at a distance from the excavator and wherein a plane defined by the force applied by the elongated support member and the first direction is normal to a plane of rotation of the cutting head.

2. The excavation method of claim 1, wherein the rotating cutting head has an axis of rotation and wherein the axis of rotation is normal to the first direction, wherein the cutting head is mounted on a boom, and wherein the boom is nonrotatably mounted on the excavator body.

3. The excavation method of claim 1, wherein the excavation face exposes an ore body, wherein the ore body has a dip of about 35° or more, wherein a deployment frame is positioned in a first excavation, wherein the excavator is positioned in a second excavation transverse to the first excavation, wherein the first excavation generally extends in a direction of a strike of the ore body, wherein the second excavation generally extends in a direction of the dip of the ore body, and wherein the powered device is positioned on the frame.

4. The excavation method of claim 1, wherein the powered device is a winch and wherein the support member is one of a wire rope and cable.

5. The excavation method of claim 3, wherein the frame comprises an excavator receiving member rotatably disposed on the frame for collaring the excavator in a slot exposing the ore body and wherein the support member supports at about 35% of the weight of the excavator during the contacting step.

6. The excavation method of claim 1, wherein a portion of the excavator is stationary during the contacting step and wherein the portion of the excavator is anchored in position using a plurality of hydraulic actuators.

7. The excavation method of claim 1, wherein the excavator comprises a boom engaging the cutting head and rotatably engaging a body of the excavator.

8. The excavation method of claim 1, wherein at least most of the body of the excavator is positioned to the side of the cutting head during the contacting step and wherein at least most of the body of the excavator is not positioned behind the cutting head during the contacting step.

9. The excavation method of claim 1, wherein the excavator comprises a sliding cutter assembly, the sliding cutter assembly receiving a cutter drive assembly and the cutting head, and a body and wherein the sliding cutter assembly moves in the first direction during the contacting step while the body remains stationary.

* * * * *